United States Patent [19]

Uyeda et al.

[11] 4,317,566

[45] Mar. 2, 1982

[54] SINGLE COLUMN EXERCISING APPARATUS

[75] Inventors: Tim M. Uyeda, S. San Gabriel; Parker E. Mahnke, Glendale, both of Calif.

[73] Assignee: Marcy Gymnasium Equipment Co., Alhambra, Calif.

[21] Appl. No.: 51,049

[22] Filed: Jun. 22, 1979

[51] Int. Cl.[3] ..... A63B 21/06

[52] U.S. Cl. ..... 272/118; 272/143

[58] Field of Search ..... 272/118, 134, 143, DIG. 4, 272/130, 142

[56] References Cited

U.S. PATENT DOCUMENTS

| | | | |
|---|---|---|---|
| 3,840,227 | 10/1974 | Chesemore | 272/118 |
| 3,912,263 | 10/1975 | Yatso | 272/118 |
| 3,971,555 | 7/1976 | Mahnke | 272/118 |
| 4,010,947 | 3/1977 | Lambert | 272/118 |

*Primary Examiner*—Richard C. Pinkham
*Assistant Examiner*—William R. Browne
*Attorney, Agent, or Firm*—James E. Brunton

[57] ABSTRACT

A progressive resistance exercising machine having a single, substantially vertical guide column adapted to guide a vertically reciprocative carriage provided with a laterally outwardly extending lifting arm engageable by the trainee. The design of the highly compact machine is unique in that the guide column, as well as a weight selector bar which is connected to the carriage, extends through centrally disposed apertures formed in a plurality of weights positioned substantially directly below the carriage. When the selector bar is selectively interconnected with one or more weights in the weight stack, a lifting force exerted on the lifting arm will cause the carriage and the selector bar to move upwardly against the urging of the weights. As the carriage moves upwardly, the central guide column accomplishes the dual function of uniquely guiding the travel of the carriage as well as constraining the path of travel of the weights thereby eliminating the need for a separate guide for guiding the weights and the carriage.

10 Claims, 6 Drawing Figures

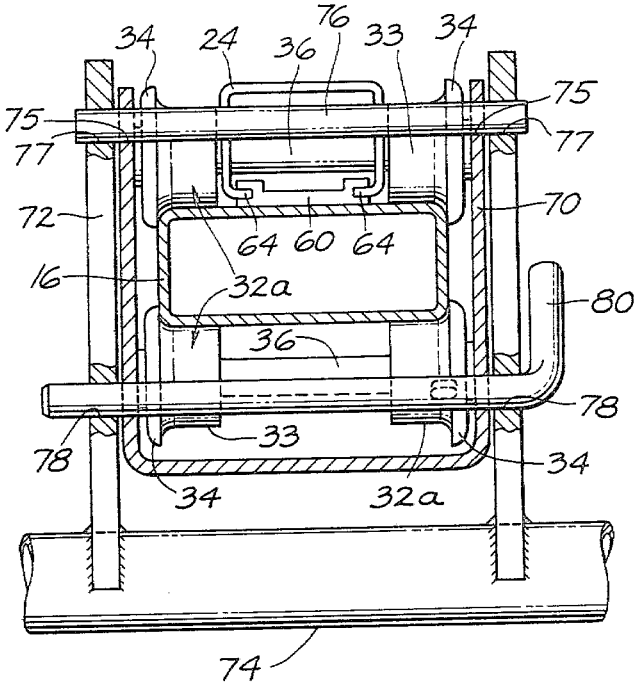
FIG. 6.
FIG. 4.
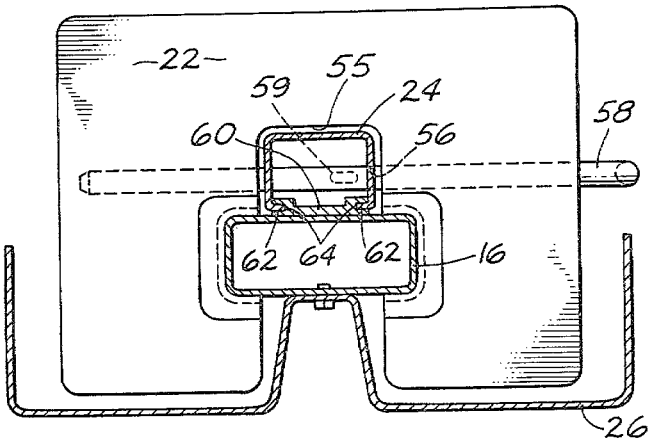
FIG. 5.
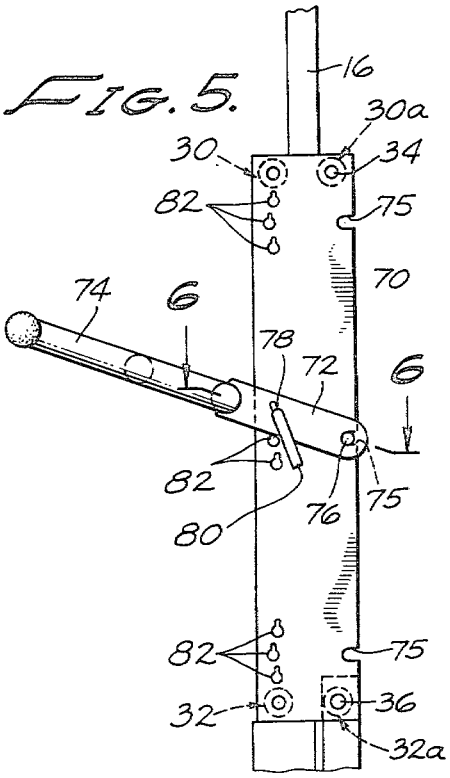
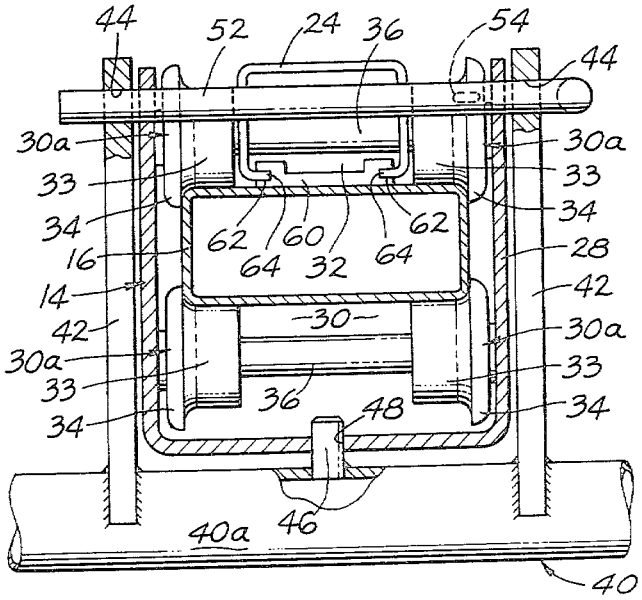
FIG. 3.

SINGLE COLUMN EXERCISING APPARATUS

BACKGROUND OF THE INVENTION

1. Field of the Invention

The present invention relates generally to exercising apparatus and more particularly to a compact, wall mounted exercising machine for accomplishing progressive resistance exercises.

2. Discussion of the Prior Art

The therapeutic value of progressive resistance exercises has long been recognized. Exercising muscles against progressively increasing weights not only results in added strength and endurance in the muscles, but also in the improvement of neuromuscular coordination and in a more efficient functioning of the cardiovascular and respiratory systems.

Traditionally apparatus such as dumbbells and barbells have been used for progressive exercises. The use of such apparatus, however, can be extremely dangerous when undertaken without proper training and supervision. When a large amount of weight is being lifted, barbells are particularly dangerous and present difficult balancing problems. If they are dropped, serious injury can result to the trainee or to those about him.

In the past, various types of progressive weight training machines have been suggested to overcome the drawbacks of barbells and dumbbells. However, to provide the required versitility and insure trainee safety such machines have typically been quite large and bulky and have required substantial amounts of floor space.

Among the most successful prior art devices known to applicant are those described in U.S. Pat. No. 3,971,555 and in U.S. Pat. No. Re. 28,066. Applicant is also familiar with U.S. Pat. Nos. 3,905,599 and 3,912,263. The aforementioned patents represent the most pertinent are known to applicant and serve to illustrate the novelty of the apparatus of the present invention.

SUMMARY OF THE INVENTION

It is an object of the present invention to provide an improved, wall mounted progressive resistance exercise machine which is simpler, less bulky, and less weighty than prior art machines making it ideally suited for use in homes, apartments and offices as well as in gymnasiums.

More particularly, it is an object of the invention to provide an exercise machine of the aforementioned character which includes a vertically reciprocative carriage biased against vertical upward movement by a plurality of weights disposed substantially below the carriage. The machine is of a unique design embodying a single central column which not only functions to guide vertical movement of the carriage, but also functions to guide vertical travel of the weights.

Another object of the invention is to provide a machine of the type described which uses a vertically movable direct connection between the carriage and the weights and in which said direct connection is receivable through and is positively guided by central apertures formed in the individual weights.

Still another object is to provide such a machine which embodies a minimum number of component parts, does not utilize ropes, cables, pulleys or the like and, therefore, is smoother, safter and more positive in operation.

A further object is to provide a machine of the type described in the proceeding paragraphs which includes a unique carriage reciprocation system comprising vertically spaced apart rollers adapted to rollably engage the front and rear surfaces of the single central column of the machine.

The superior engineering design and overall simplicity and compactness of the machine of the present invention permits it to be inexpensively manufactured, easily set up and operated in numerous locations, and to be safely used even by unskilled persons with a minimum of training.

In summary, these and other objects of the present invention are realized by an exercising apparatus comprising a vertically reciprocative carriage, having first and second vertically spaced apart bearing means; a substantially vertically disposed central guide column having first and second guide means for guiding said first and second bearing means of the carriage; body engaging means projecting laterally outward from the carriage for moving the carriage upwardly relative to the central guide column; and biasing means for biasing the carriage against upward movement.

BRIEF DESCRIPTION OF THE DRAWINGS

FIG. 3 is a cross-sectional view taken along lines 3—3 of FIG. 2 illustrating the construction of the body engaging means and its method of connection to the reciprocal carriage.

FIG. 4 is a view taken along lines 4—4 of FIG. 2 illustrating the unique construction of the central guide column, the selector bar and the apertured weights of the apparatus.

FIG. 5 is a fragmentary side elevational view showing another embodiment of the single column exercising apparatus of the invention.

FIG. 6 is a cross-sectional view taken along lines 6—6 of FIG. 5.

DESCRIPTION OF THE INVENTION

Figure 1:
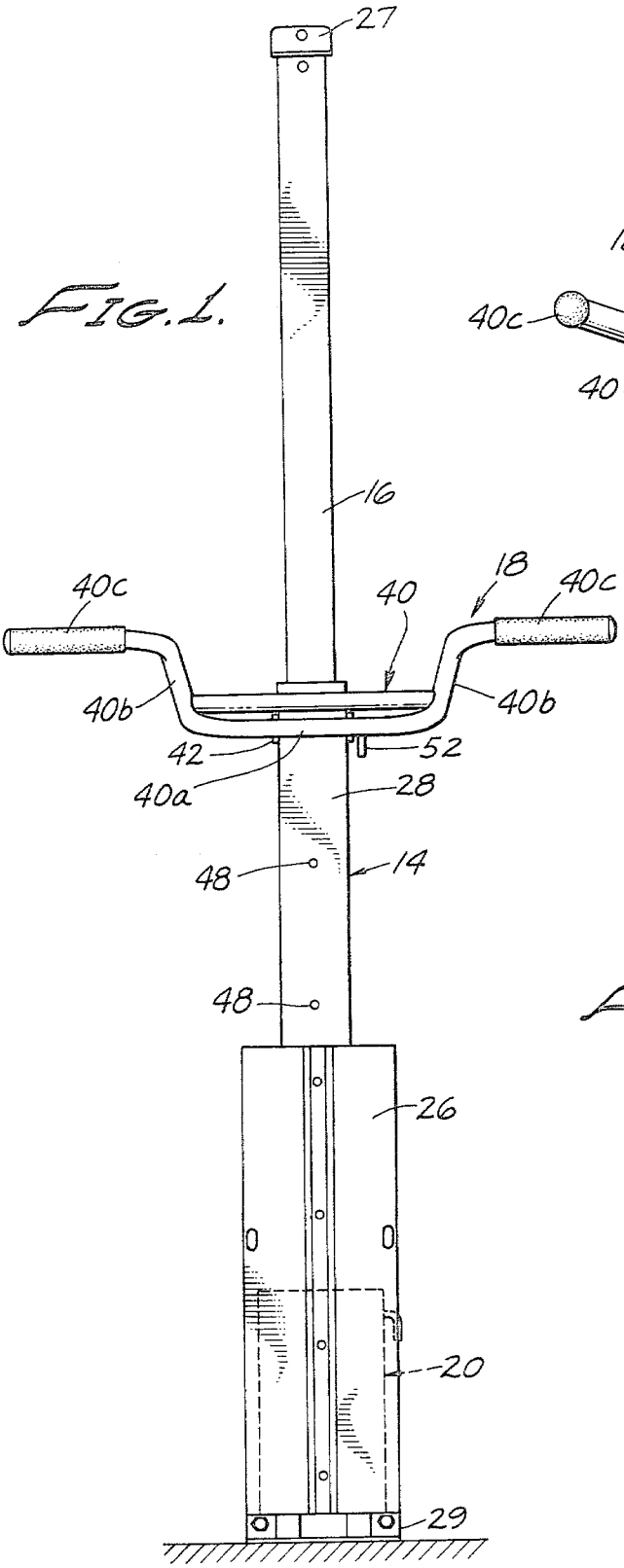
FIG. 1 is a front elevational view of the single column exercising apparatus of the invention.
Figure 2:
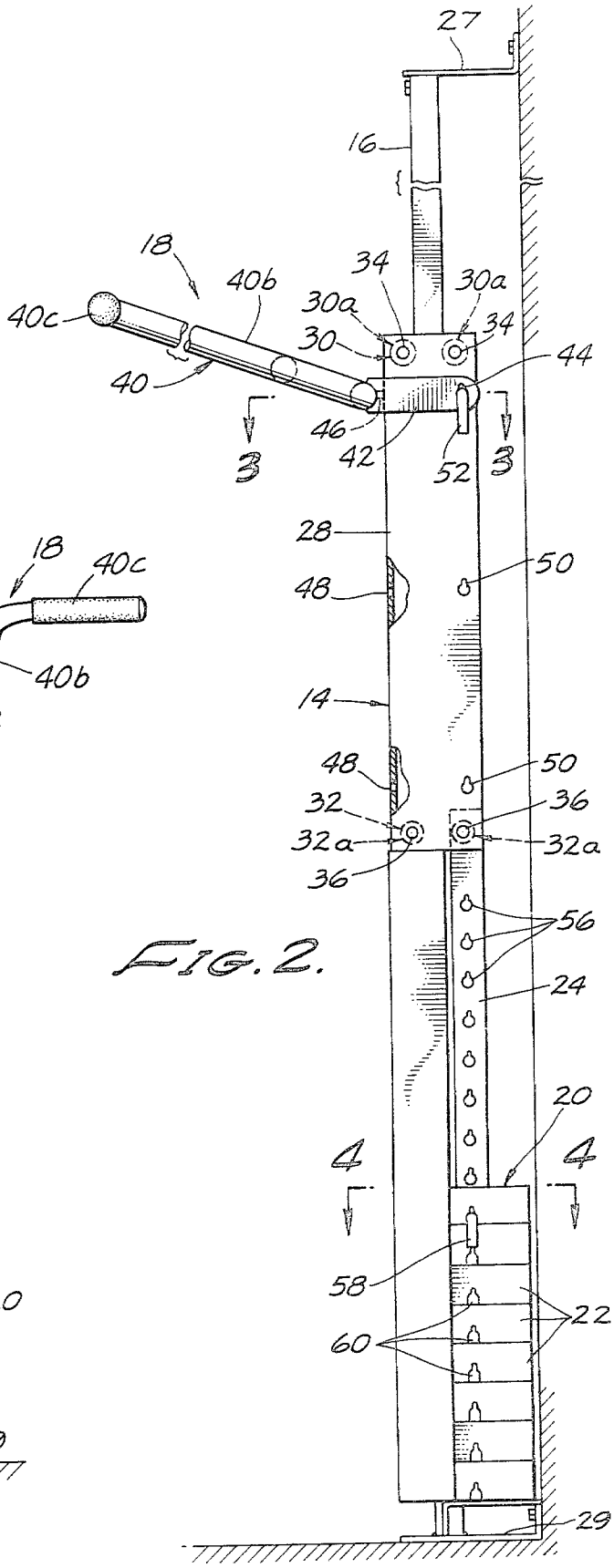
FIG. 2 is a side elevational view partly broken away to show internal construction.

Referring to the drawings, and particularly FIGS. 1 through 3, one form of the single column exercising apparatus of the invention comprises a vertically reciprocative carriage 14, a substantially vertically disposed central guide column 16, body engaging means 18 projecting laterally outward from carriage 14 and biasing means in the form of a stack of weights 20 for biasing the carriage against upward movement by forces exerted on the body engaging means. As best seen in FIG. 2, the carriage 14 and one or more of the weights 22 of the weight stack 20 can be interconnected by a selector means shown here as comprising a substantially vertically disposed connecting column 24.

Turning to FIG. 4, it can be seen that each of the weights 22 which make up the weight stack is apertured to closely receive both central guide column 16 and connecting column 24. This unique construction has numerous advantages, one of which is the elimination of the requirement for separate guide means for guiding the vertical travel of the weights within the apparatus. As also shown in FIG. 4, a protective means in the form of a rigid vertically extending shield member 26 is connected to the lower front surfaces of guide column 16 to shield the trainee from the weight stack. This protective shield precludes injury to the trainee or others should the weights accidentally be dropped during the performance of an exercise.

Referring once again to FIGS. 1 and 2, brackets 27 and 29 are provided at the top and bottom of vertical column 16 to conveniently attach the apparatus to a wall or other vertical structural member. When the apparatus is installed in the manner shown in the drawings, brackets 27 and 29 securely position the central guide column 16 in a spaced apart relationship with respect to the wall or other vertical structure. Because of the unique single column design of the apparatus, a minimum amount of floor space and wall area is required to install the apparatus. This feature, along with the simplicity of the design and maximum weight savings attributable thereto, permits the apparatus to be conveniently installed and used in homes, offices or apartments, as well as in gymnasiums.

Turning now to FIG. 3, carriage 14 is seen to comprise a generally "U" shaped housing 28 adapted to carry first and second vertically spaced apart bearing or roller means. In the embodiment of the invention shown in the drawings, these latter means are provided in the form of upper and lower sets of wheel means 30 and 32 respectively (FIG. 2). Upper wheel means 30 include front and rear pairs of rollers 30*a* which are coaxially mounted on horizontally spaced apart axles 34 carried by housing 28. Similarly lower wheel means 32 include front and rear pairs of rollers 32*a* which are coaxially mounted on horizontally spaced apart axle members 36 carried by "U" shaped housing 28. Rollers 30*a* and 32*a* are of identical configuration, each having hub portions 33 and flange portions 34.

Central guide column 16 is provided first and second guide means for guiding said bearing or roller means of the carriage 14. In the embodiment of the invention shown in the drawings, central guide column 16 is substantially rectangular in cross-section and said first and second guide means comprise front and rear guide surfaces which are rollably engaged by the hub portions 33 of rollers 30*a* and 32*a*. Central guide column 16 is also provided with guide surfaces of each side thereof, adapted to be rollably engaged by flange portions 34 of rollers 30*a* and 32*a*.

As will be discussed in greater detail hereinafter, an important and highly novel feature of the invention resides in the fact that the single central column 16 not only functions to guide vertical travel of the carriage in the manner just described, but also functions to guide the vertical travel of the weights thereby eliminating the need for separate guide columns for the weights.

In the form of the invention shown in FIGS. 1 through 4, the body engaging means 18 comprises a lifting arm or handle bar structure 40 which can be removably connected to carriage 14 at vertically spaced apart locations. Referring to FIG. 1, lifting arm 40 includes a central portion 40*a*, a pair of flared out portions 40*b* and a pair of handle portions 40*c*. As shown in FIG. 3, extending rearwardly from central portion 40*a*, is a pair of transversely spaced apart arm members 42, each of which is provided with a keyhole shaped aperture 44 proximate its inboard end. Disposed intermediate arms 42 and extending rearwardly from central portion 40*a* of handle bar 40 is a stud 46 adapted to be closely received in vertically spaced apart apertures 48 provided in carriage 14 (FIG. 1).

The spacing between arms 42 is slightly wider than the width of housing 28 of carriage 14 so that the lifting arm can be positioned proximate carriage 14 with stud 46 protruding through a selected aperture 48. In this position apertures 44 formed in arms 42 will align with apertures 50 provided in housing 28 at a plurality of vertically spaced apart locations (FIG. 1). The lifting arm may be locked into position relative to the carriage by inserting a locking pin 52 through apertures 44 and apertures 50. A locking means in the form of a small protuberance 54 positioned intermediate the ends of locking pin 52 prevents accidental withdrawal of the pin.

As best seen by referring to FIGS. 2, 3 and 4, connecting column 24 is substantially "U" shaped in configuration, is closely receivable in apertures 55 formed in each weight 22 and is affixed at its upper end to the lower end of carriage 14. A plurality of vertically spaced apart keyhole shaped apertures 56 adapted to closely receive a second locking pin 58 are formed along the length of the connecting column. As indicated in FIG. 2, each of the weights 22 is also apertured to closely receive locking pin 58. Apertures 56 in column 24 are arranged to index with the apertures 60 in weights 22 when the connecting column is in its lowermost position. With this construction, pin 58 may be inserted into a selected aperture in column 24 and will extend through the weight aligned therewith. In this way, one or more weights may readily be interconnected with connecting column 24 so that as carriage 14 is raised through exertion of an upward force on handle bar 40, the weights in the weight stack above pin 58 will also move upwardly relative to central column 16. Pin 58 is also provided with a protuberance 59 located intermediate its ends to prevent accidental withdrawal of the pin.

An important and novel feature of the present invention comprises third guide means provided in guide column 16 for guiding the vertical travel of connector column 24. In the present form of the invention, the third guide means comprises a track 60 affixed to the rear surface of the guide column (FIGS. 3 and 4). Track 60 has a pair of vertically extending spaced apart channels 62 adapted to slidably receive inturned end portions 64 formed on the side walls of connector column 24. Although not shown in the drawings, other equivalent types of guide means such as cooperating rollers, slides and the like could, of course, also be used to operably interconnect column 24 and central guide column 16.

Turning now to FIGS. 5 and 6 there is illustrated an alternate embodiment of the exercising apparatus of the present invention. This embodiment is similar in most respects to the embodiment previously described herein save for the construction of the body engaging means and its method of attachment to the reciprocative carriage. In the drawings, like numbers are used to identify like parts. As was the case in the previously described embodiment, carriage 70 is generally "U" shaped in cross-section and is stradled by spaced apart arms 72 affixed to the handle bar, or lifting arm, 74 of the apparatus. As indicated in FIG. 5, the entire body engaging means including transversely spaced apart arms 72 lies in a single plane rather than being angularly inclined as was the case in the previously described embodiment. Additionally, in this form of the invention, the body engaging means is both vertically adjustable and pivotally movable relative to the carriage. Accordingly, the vertical starting height of the body engaging means can be adjusted relative to the carriage by vertical movement of arm 74, and also by pivoting the arm with respect to the carriage into different angular orientations. As best seen in FIG. 5, the carriage is provided with a plurality of spaced apart pairs of slots 75 formed in the rear edges of "U" shaped member 70. These slots are adapted to closely receive a transverse pin 76 which is fixedly positioned within apertures 77 formed proximate the inboard ends of arms 72 of the body engaging means (FIG. 6).

To position the body engaging means at a selected vertical height, pin 76 is first introduced into one of the pairs of slots 75 in member 70. To enable the lifting bar to be adjusted to a selected angle relative to the carriage, arms 72 have apertures 78 formed intermediate their ends which are adapted to closely receive a second locking pin 80 which may be inserted into the aperture and extend through one of several apertures 82 formed in the side walls of "U" shaped member 72. As illustrated in FIG. 5, apertures 82 are located along an arc of a circle so that as the body engaging means pivots about pin 76 the apertures in side arms 72 will align with a set of apertures 82 formed in the side wall of member 70.

OPERATION

In operating the apparatus of the invention, the trainee first adjusts the body engaging means relative to the carriage so that the handle bar grips are positioned at the correct vertical starting height for the particular exercise to be performed. Next, the trainee inserts selector pin 58 into the proper aperture in a given weight 50 to interconnect the desired number of weights with the connective column 24. He thereupon, by exerting upward pressure on the handles 40*c* raises the carriage 14, the connecting column 24 and the weights located above pin 58. This lifting force tends to apply an eccentric force to the carriage. However, due to the design of the bearing or roller means of the carriage and the cooperating guide means of the central guide column this tendency is effectively overcome so that the carriage travels in substantially a vertically straight line.

It is important to observe that as the carriage moves upwardly and downwardly, the central guide column not only constrains the path of travel of the carriage, but also of the connecting column 24 and the weights 22. The single central guide column construction of the apparatus is highly novel and provides a mode of operation which was heretofore unknown in exercise equipment. The unique configuration of the device minimizes the number of component parts required, markedly reduces the weight of the unit and ensures safe, positive, reliable and trouble free operation.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example. We do not wish to be restricted to the specific forms shown or uses mentioned except as defined in the accompanying claims, wherein various portions have been separated for clarity of reading and not for emphasis.

We claim:

1. An exercising apparatus, comprising:

(a) a vertically reciprocative carriage, having first and second vertically spaced apart roller means, said roller means comprising upper and lower rollers;

(b) only one single substantially vertically disposed central guide column having first and second guide means for guiding said first and second roller means of said carriage; said first guide means comprising a front surface of said central column and said second guide means comprising a rear surface of said central column, said front and rear surfaces being engageable by said first and second vertically spaced apart roller means of said carriage whereby one of said upper and lower rollers of said roller means is in roller engagement with said front surface and the other of said upper and lower rollers of said roller means is in rolling engagement with said rear surface;

(c) body engaging means projecting laterally outward from said carriage for moving said carriage upwardly relative to said central guide column;

(d) a plurality of weights disposed substantially directly below said carriage, each of said weights having a centrally located aperture, said aperture being adapted to receive said guide column; and (e) a substantially vertically disposed connecting column connecting to said carriage and adapted to be selectively connected to said weights whereby said carriage is biased in a vertically downward direction, said connecting column being closely receivable in said aperture formed in said weights.

2. An exercising apparatus as defined in claim 1 in which each of said upper and lower rollers comprises two sets of coaxial rollers one set being in rolling engagement with said front surface of said central column and the other set being in rolling engagement with said rear surface of said central column.

3. An exercising apparatus, comprising:

(a) a vertically reciprocative carriage including a housing and vertically spaced apart roller means mounted internally of said housing;

(b) only one single substantially vertically disposed central guide column having first and second guide surfaces, said first and second roller means of said carriage engaging and rolling along said first and second guide surfaces respectively;

(c) body engaging means projecting laterally outwardly from said carriage for engagement by a trainee to impart vertical reciprocative movement to said carriage, whereby a lifting force exerted on said body engaging element tends to apply an eccentric force to said carriage, said roller means being adapted to counteract the tendency to apply said eccentric force;

(d) a plurality of apertured weights, each provided with a centrally disposed aperture, said aperture being arranged to closely receive said central guide column; and (e) selector means receivable within said aperture of said weights for selectively interconnecting said carriage and said weights whereby said carriage is selectively adjustable relative to said selector means and is biased in a vertically downward direction.

4. An exercising apparatus as defined in claim 3 in which said housing of said carriage is provided with spaced apart locating apertures and in which said body engaging means is provided with first locking means receivable in said apertures whereby said body engaging means can be positioned at selected vertical starting heights.

5. An exercising apparatus as defined in claim 4 in which said body engaging means is pivotally movable into various angular orientations relative to said carriage.

6. An exercising apparatus as defined in claim 5 in which said body engaging means is provided with second locking means for locking it relative to said carriage in at least one selected angular orientation.

7. An exercising apparatus, comprising:

(a) a vertically reciprocative carriage;

(b) a plurality of weights disposed substantially directly below said carriage, each of said weights having a centrally located aperture;

(c) a substantially vertically disposed connecting column connected to said carriage and adapted to be selectively connected to said weights whereby said carriage is biased in a vertically downward direction, said connecting column being closely receivable in said aperture formed in said weights;

(d) only one single substantially vertically disposed central guide column closely receivable in said aperture formed in said weights and central guide column having:

(1) first guide means for guiding said carriage, said first guide means comprising a front surface of said central column;

(2) second guide means for guiding said carriage, said second guide means comprising a rear surface of said central column, said front and rear surfaces being engageable by said vertically reciprocative carriage; and (3) third guide means for guiding vertical travel of said carriage and said connecting column as said carriage reciprocates; and (e) body engaging means projecting laterally outward from said carriage for moving said carriage upwardly relative to said central guide column.

8. An exercising apparatus as defined in claim 7 in which said third guide means comprises connecting column engaging means provided on the rear surface of said central guide column for guidably engaging said connecting means upon vertical reciprocative movement of said carriage.

9. An exercising apparatus, comprising:

(a) at least one weight having a central disposed aperture formed therein;

(b) a vertical reciprocating carriage;

(c) a substantially vertically disposed, reciprocally movable connecting column connected to said at least one weight and said carriage whereby said connecting column is based in a vertically downward direction, said connecting column being receivable in said aperture formed in said weight;

(d) only one single substantially vertically disposed stationary central guide column receivable in said aperture formed in said at least one weight; and (e) laterally projecting body engaging means operably associated with said connecting column for moving said connecting column upwardly relative to said central guide column against the urging of said weight; said body engaging means including bearing means adapted to engage said central guide column.

10. An exercising apparatus, comprising:

(a) a vertically reciprocative carriage including spaced apart bearing means;

(b) only one single substantially vertically disposed central guide column having guide surfaces, said bearing means of said carriage being adapted to engage and travel along said guide surfaces;

(c) body engaging means projecting laterally outwardly from said carriage for engagement by a trainee to impart vertical reciprocative movement to said carriage, whereby a lifting force exerted on said body engaging element tends to apply an eccentric force to said carriage, said bearing means being adapted to counteract the tendency to apply said eccentric force;

(d) a plurality of weights; and (e) selector means for selectively interconnecting said carriage and said weights whereby said carriage is biased in a vertically downward direction.

* * * * *